US005326241A

United States Patent [19]

Rook et al.

[11] Patent Number: 5,326,241

[45] Date of Patent: Jul. 5, 1994

[54] APPARATUS FOR PRODUCING ORGANIC FIBERS

[75] Inventors: Robert H. Rook; Daniel C. Bajer; Fred L. Jackson, all of Littleton, Colo.

[73] Assignee: Schuller International, Inc., Denver, Colo.

[21] Appl. No.: 869,555

[22] Filed: Apr. 15, 1992

Related U.S. Application Data

[63] Continuation-in-part of Ser. No. 691,572, Apr. 25, 1991, Pat. No. 5,242,633.

[51] Int. Cl.[5] ..... B29C 47/08

[52] U.S. Cl. ..... 425/7; 65/6; 65/14; 264/8; 264/12; 425/8; 425/72.2; 425/464

[58] Field of Search ..... 65/6, 8, 14, 5, 15, 65/16; 425/6, 8, 9, 72.2, 381.2, 378.2, 382.2, 7, 72.1, 464; 264/8, 176.1, 12, D75, 569, 211.1

[56] References Cited

U.S. PATENT DOCUMENTS

| | | | |
|---|---|---|---|
| 2,192,944 | 3/1940 | Thomas | 65/16 |
| 2,577,204 | 12/1951 | McElroy | 65/14 |
| 3,026,563 | 3/1962 | Slayter et al. | 65/14 |
| 3,174,182 | 3/1965 | Duncan | 425/8 |
| 3,215,514 | 11/1965 | Levecque et al. | 65/6 |
| 3,249,413 | 5/1966 | Simmers et al. | 65/16 |
| 3,265,483 | 8/1966 | Garrison et al. | 65/6 |
| 3,266,085 | 8/1966 | Nacke | 264/8 |
| 3,293,695 | 12/1966 | Baymiller et al. | 425/8 |
| 3,347,648 | 10/1967 | Krakauer et al. | 65/8 |
| 3,374,075 | 3/1968 | Maddox et al. | 65/6 |
| 3,395,005 | 7/1968 | Stelmah | 65/16 |
| 3,483,281 | 12/1969 | Chisholm | 425/8 |
| 3,841,854 | 10/1974 | Periat et al. | 65/15 |
| 4,058,386 | 11/1977 | Faulkner et al. | 65/6 |
| 4,178,336 | 12/1979 | Snowden | 264/12 |
| 4,197,063 | 4/1980 | Davidson | 65/15 |
| 4,277,436 | 7/1981 | Shah et al. | 65/6 |
| 4,302,234 | 11/1981 | Guffey et al. | 65/6 |
| 4,303,430 | 12/1981 | Houston | 65/14 |
| 4,323,524 | 4/1982 | Snowden | 264/8 |
| 4,534,779 | 8/1985 | Herschler | 65/6 |
| 4,627,868 | 12/1986 | Kaveh | 65/6 |
| 4,689,061 | 8/1987 | Britts, II et al. | 65/6 |
| 4,808,097 | 2/1989 | Takahashi et al. | 425/8 |
| 4,917,715 | 4/1990 | Kaveh et al. | 65/6 |
| 5,118,332 | 6/1992 | Hinze | 264/8 |
| 5,123,949 | 6/1992 | Thiessen | 264/8 |

FOREIGN PATENT DOCUMENTS

| | | | |
|---|---|---|---|
| 641809 | 5/1962 | Canada | 65/6 |
| 202469 | 3/1907 | Fed. Rep. of Germany | 425/9 |
| 1289614 | 2/1969 | Fed. Rep. of Germany | 65/6 |
| 2602902 | 7/1976 | Fed. Rep. of Germany | 65/6 |
| 787181 | 12/1980 | U.S.S.R. | |

*Primary Examiner*—Jay H. Woo
*Assistant Examiner*—Joseph Leyson
*Attorney, Agent, or Firm*—Cornelius P. Quinn

[57] ABSTRACT

Apparatus for producing organic fibers by means of a centrifugal spinning process. The fiberizing disc and the molten material introduction nozzle are designed to prevent the molten material from escaping the disc prior to being fiberized. The heater for heating the material in the disc is designed to accommodate the lower melt temperature of the material to be fiberized. Also, means are provided for diverting the flow of fibers from the disc to cause the fibers to be more precisely or uniformly deposited. The fibers are substantially immediately cooled upon exiting the fiberizing disc, resulting in a fiber structure that is at least about 60% amorphous.

12 Claims, 6 Drawing Sheets

APPARATUS FOR PRODUCING ORGANIC FIBERS

This is a continuation-in-part of application Ser. No. 07/691,572, filed Apr. 25. 1991, now U.S. Pat. No. 5,242,633.

FIELD OF THE INVENTION

This invention relates to the production of organic fibers. More particularly, it relates to the production of fine organic fibers by means of a rotary process.

BACKGROUND OF THE INVENTION

There is an increasing demand for organic polymer or thermoplastic fibers of small diameter, often referred to as microfibers, for a variety of uses, such as, for example, in the manufacture of filter media or sorbent material. A preferred method of producing such fibers is by a rotary process whereby molten polymer is fed to a spinning disc containing a myriad of small holes through which the material flows by reason of centrifugal force. The rotary method not only enables large quantities of fiber to be produced at a rapid rate, but permits the physical parameters of the fibers to be more readily controlled.

The specific type of rotary process employed can vary a great deal. As one example, apparatus ms described in U.S. Pat. No. 4,937,020 which utilizes a rotating nozzle head to which molten polymer is introduced under preliminary pressure, and the resulting fibers are additionally drawn by gas streams exiting the nozzle head in the vicinity of the nozzle holes. The nozzle head includes separate passages through which molten polymer and gases flow, each passage including axial and radial components. In addition, heating coils are included for controlling the temperature of the melt at the exit holes. Because the process essentially takes place entirely within the nozzle head, the nozzle head and its various components must be manufactured to extremely demanding tolerances. Thus the cost of the process equipment would tend to be high and the maintenance of the equipment would be difficult.

It would be preferable to utilize a process made up of individual components which are more economical to produce and maintain, yet which enable organic polymer fibers of various parameters to be readily produced at high rates. Further, it would be desirable to be able to produce organic polymer fibers in much the same way as microfibers of glass are produced, to take advantage of proven procedures for manufacturing fibers from molten material at high production rates. Moreover, the equipment employed in the manufacture of glass microfibers is relatively simple in design and is not dependent on self-contained nozzle constructions such as that described in the above-mentioned patent.

Unfortunately, it is not possible to produce satisfactory fibers by simply running molten polymer through rotary fiber glass equipment. A basic reason for this is that the design of equipment used to produce glass microfibers is determined to a large extent by the temperature and physical characteristics of the molten glass. Because the temperature and specific gravity of molten glass are considerably higher than the temperature and specific gravity of molten polymers, the equipment and process parameters used in glass microfiber production cannot be used to produce organic polymer fibers.

It is therefore an object of the invention to provide simplified equipment for the production of organic polymer fibers, utilizing the principles where possible of the basic rotary method of manufacturing glass microfibers.

It will be understood that although the following description refers to the manufacture of fibers primarily from molten organic polymer or thermoplastic resin, the term "organic polymer" is sometimes used to refer to both types of materials. Where appropriate, this term may also be interpreted as including thermosetting resins as well, as explained more fully in the specification.

BRIEF SUMMARY OF THE INVENTION

In accordance with the invention, a fiberizing disc is connected to a shaft mounted for axial rotation, the disc including a bottom wall, a circular sidewall extending upwardly from the bottom wall, and an upper flange extending inwardly from the upper end of the sidewall. Molten organic material is introduced into the rotating disc by means of a nozzle located between the bottom wall, the sidewall and a plane extending through the upper end of the sidewall parallel to the bottom wall. By uniformly heating the interior of the disc to maintain the material in a molten state, the molten material is centrifugally forced through fiberizing holes in the sidewall of the disc. In a preferred arrangement, the nozzle is placed as close to the bottom wall and the sidewall as possible. Generally, this would place the nozzle in the range of about ½ inch to 1½ inches from the bottom wall, and in the range of about ½ inch to 3 inches from the sidewall. Preferably, the nozzle is directed generally outwardly at an angle to both the bottom wall and the sidewall, whereby molten material discharged from the nozzle has both downward and sideward components of direction.

This construction, as explained in more detail hereinafter, permits the rapid production of organic fibers by a method generally similar to the proven rotary fiberizing methods of manufacturing glass fibers, even though the material in question is quite different in character from glass.

The basic disc structure and other features of the apparatus may be modified in a number of ways to provide further benefits. A bottom flange may be provided so as to extend from the sidewall beyond the bottom wall, to form with the bottom wall an enclosure which can be used to house insulation material or a bottom heater for assisting to control the temperature within the disc. Instead of the conventional form of disc, an annular disc may be used. With either type of disc design, the disc may be heated by means of induction heating.

An improved gas fired heater is also provided for heating the interior of the disc, wherein a gas burner and inspirating nozzle are located above the disc. Means are provided for introducing a cooling gas, usually ambient air, into the mixing nozzle to reduce the temperature of the discharge from the burner, which prevents or minimizes oxidation and degradation of the polymer or thermoplastic melt.

Means are also provided for altering the normal flow of the stream of fibers exiting from the disc in order to better control the deposition of the fibers. In one arrangement the air ring conventionally supplied for directing compressed air in a downward direction has been modified to permit the air to be selectively directed from various points of the ring. In another arrangement means are provided for outwardly diverting downward movement of fibers exiting from the disc so as to cause the fibers to be more uniformly deposited on a moving collection surface beneath the disc. The diverting means employed may comprise a blast of compressed air or a structure which physically moves the falling fibers from the central portion of the moving collection surface to the side portions.

It is also desirable to heat the molten material in the transfer tube used to deliver the material to the nozzle in order to maintain the temperature of the flowing molten material within a predetermined range for optimum fiberization.

These features as well as other features and aspects of the invention, and the various benefits thereof, will be apparent from the more detailed description of the preferred embodiments which follows.

DETAILED DESCRIPTION OF THE PREFERRED EMBODIMENTS

Figure 1:
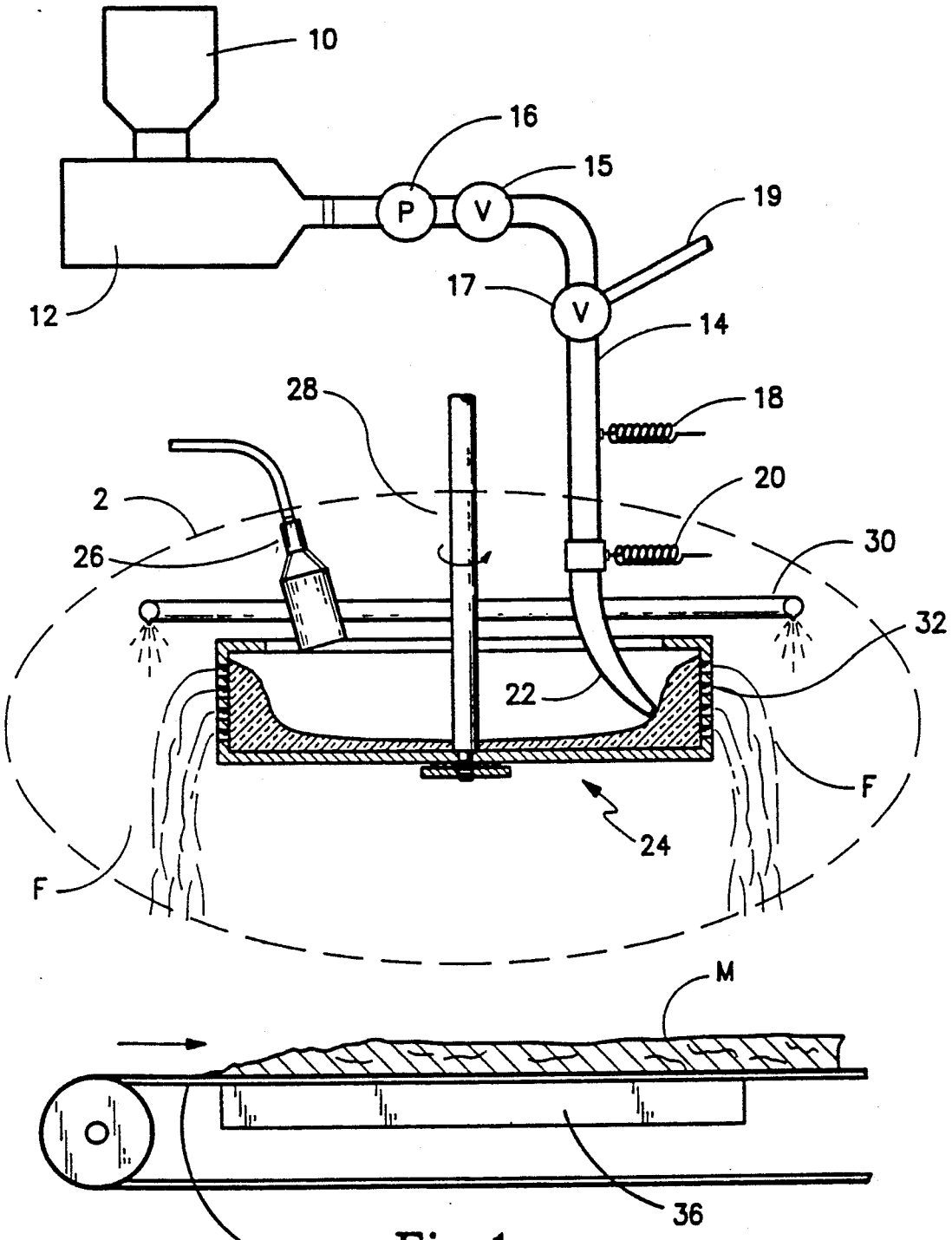
FIG. 1 is a simplified side elevation of the apparatus used in producing organic polymer fibers by means of the present invention.

Referring to FIG. 1, a hopper 10 containing polymer granules or powder communicates with extruder 12, enabling the granules to be fed to the extruder where they are melted by means of heaters and conveyed to a rotating screw. Neither the heater nor the screw are shown, since their construction details are not part of the invention. Both items, however, are well known components of extruder systems and are familiar to those knowledgeable in the fiberizing art. A transfer tube 14 connected to the outlet of the extruder 12 receives the flow of melted polymer through a suitable valve 15, such as a high temperature needle valve. A gear pump 16 can be used to provide required back pressure for the extruder and to ensure regulated flow of polymer to the disc. The transfer tube 14 is heated by an electrical resistance heater and monitored using a thermocouple 18 in order to maintain the temperature of the molten polymer within a narrow range, such as within 5° F. of the desired temperature of the flowing polymer. It will be understood that although the details of the transfer tube are not shown, the heated transfer tube will be insulated to prevent the escape of heat, thereby aiding in the control of the polymer temperature. A thermocouple 20 may also be provided to monitor the desired temperature of the polymer as it is flows into the transfer hose nozzle 22.

The nozzle 22 is positioned to deliver molten polymer to disc 24, and a heater 26 is mounted adjacent the disc. The disc is mounted on rotating shaft 28 for movement therewith. An air ring 30 mounted above the rotating disc 24 directs compressed air downwardly so that fibers F exiting from holes 32 in the sidewall of the disc are both attenuated and caused to move in a stream down to the moving conveyor 34. The conveyor is porous, typically in the form of a tightly woven chain, so that a stationary suction box 36 beneath the conveyor causes the fibers to collect on the conveyor. The fibers thus build up to form a layer or mat M of a thickness determined by the rate of movement of the conveyor and the quantity of fibers produced by the rotating disc.

The broad process described thus far is similar in principle to the broad process of producing glass microfibers by the rotary process. Certain specific features of the present invention, however, are quite different from the glass fiber process. As mentioned above, the temperature of molten glass is higher than the temperature of molten polymer. The temperature of molten glass in a rotary process typically is in the range of 1500° F. to 3000° F., while the temperature of molten polymer in the process of the invention typically is in the range of 150° F. to 850° F., depending upon the particular polymer employed. The specific gravity and the viscosity of molten glass are also quite different from those of molten polymer. For example, the specific gravity of molten glass is in the range of 2.2 to 2.7, while the specific gravity of molten polymer used in the invention is typically in the range of 0.9 to 1.9. The ranges of temperature and specific gravity given for molten polymers also apply to thermoplastic and thermosetting resins. Discs of greater diameter than those utilized in glass fiber manufacture can be used since material strength limitations in discs caused by the higher operating temperatures of a glass fiber process no longer apply. Thus, instead of having to use discs ranging in diameter from 12 inches to 24 inches, discs can safely have a diameter in the range of 3 inches to 48 inches, enabling greater throughput and improved fiber quality.

Figure 2:
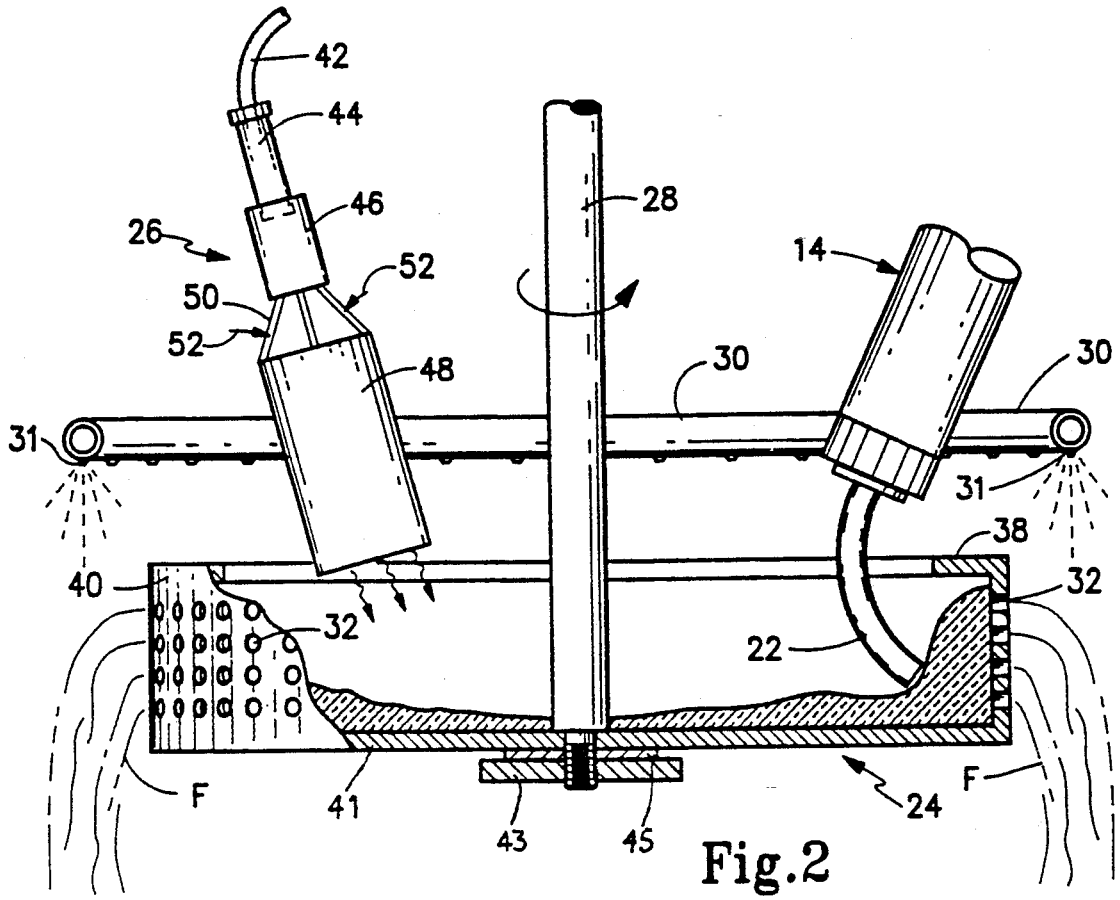
FIG. 2 is an enlarged side elevation of the fiberizing disc, shown partly in section, and associated equipment included within the circle 2 of FIG. 1.

The ability to employ larger discs is a benefit from another aspect. Because of the wide melt range of the various polymers and resins which may be formed into fibers, a wider hole separation may be required than in discs designed to operate with glass. Thus the minimum spacing between the holes 32 of the disc, better shown in FIG. 2, is 0.010 inch to 0.150 inch. As to the hole diameter itself, this may range from 0.003 inch to 0.080 inch. This compares directly with the hole size of discs utilized in the manufacture of glass fibers.

Figure 2A:
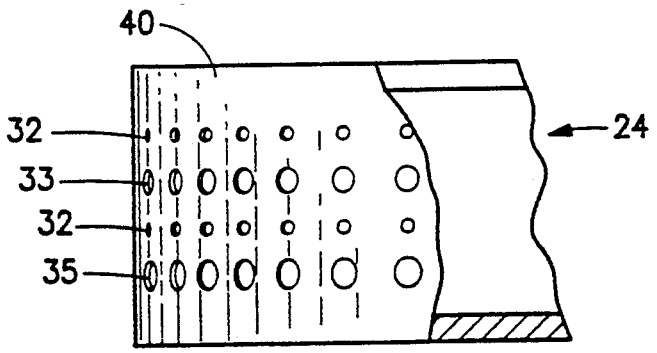
FIG. 2A is a further enlarged view of a portion of the fiberizing disc, illustrating a modified hole arrangement wherein different size holes are used in various patterns.

As illustrated in FIG. 2A, the disc 24 may be provided with holes of varying size in order to simultaneously produce fibers of different diameter to reduce size variations or to compensate for the disc sidewall temperature profile. To illustrate, the holes 32 are shown as being relatively small, the holes 33 as being somewhat larger, and the holes 35 as being larger still. Although the various hole sizes have been shown as being the same within each horizontal row, the distribution of hole sizes may obviously be varied within each row in any desired manner in order to produce the desired form or pattern of fiber distribution. Although the modified disc of FIG. 2A is disclosed in connection with the manufacture of organic fibers, it will be appreciated that fiberizing discs containing holes of varying size could also have utility in the manufacture of inorganic fibers.

In the manufacture of glass fibers the specific gravity of molten glass allows it to be delivered to a rotating disc with only minor concern about retaining it in the disc prior to being centrifugally forced through the holes in the disc sidewall. Thus, molten glass is delivered in a stream to a convenient location on the bottom wall of a disc, and it flows relatively smoothly toward the sidewall. Because the specific gravity of molten polymer material is significantly lower, as pointed out above, molten polymer may tend to be randomly distributed against the sidewall 40 and bounce out of the rotating disc. This results from the fact that air currents generated in the process tend to move the molten stream as it is delivered to the disc and the spinning disc itself tends to pull the stream in the direction of rotation. In addition, relatively high viscosity molten polymer does not flow easily toward the sidewall of the disc and at times tends to be flung about in gobs. In order to combat these tendencies of the molten material to behave in a manner contrary to the behavior of molten glass in a rotary fiberization process, it has been found necessary to deliver the material to the disc through the transfer hose delivery nozzle 22. By positioning the nozzle close to the bottom wall and sidewall of the disc, the length of the molten polymer stream and the distance it must be moved toward the sidewall are both reduced. It has been found that the nozzle preferably should be spaced as close to the bottom wall as possible, typically a distance in the range of about ½ inch to 1½ inches, and as close to the sidewall as possible, typically a distance in the range of about ½ inch to 3 inches. This minimizes the problems described above. In addition, the nozzle is preferably curved as shown in FIG. 2 so that the stream discharged from the nozzle has both horizontal and vertical components of direction. The molten polymer is thereby further aided in its movement toward the sidewall.

The sidewall and top flange of the disc are also designed to optimally receive molten polymer. As best shown in FIG. 2, a relatively wide top flange 38 is provided to prevent molten polymer from bouncing or splashing out of the disc. The width of the top flange should be about ½ inch for a disc having a diameter of 3 inches and about 6 inches for a disc with a diameter of 48 inches, with the width varying accordingly for discs of intermediate diameters. The sidewall 40 is higher than is normal in a glass fiber manufacturing disc, ranging from about 1 inch to 6 inches in height. This is also for the purpose of containing the polymer melt as it is introduced into the rotating disc. As illustrated, the bottom wall 41 is connected to the lowermost edge of the sidewall 40 and is provided with a central opening through which the shaft 28 extends. The disc may be held in place by any suitable means, such as by the nut 43 engaging the threaded end of the shaft. A flat washer 45 typically is provided between the nut 43 and the bottom wall 41 of the disc.

Because the temperature of the molten material is lower than that of molten glass, it is not necessary to provide as much heat to the disc in order to maintain the material in a molten state. One or more gas burners located inside the rotary fiberizing disc, as is done in the manufacture of glass fibers, would tend to provide too much heat and make it difficult to control the temperature. Excessive heat may also degrade the polymer. In accordance with the invention, one or more gas burners are provided outside the disc, the burners being of a design to provide heat at a lower temperature than a conventional gas burner is able to do.

Figure 2B:
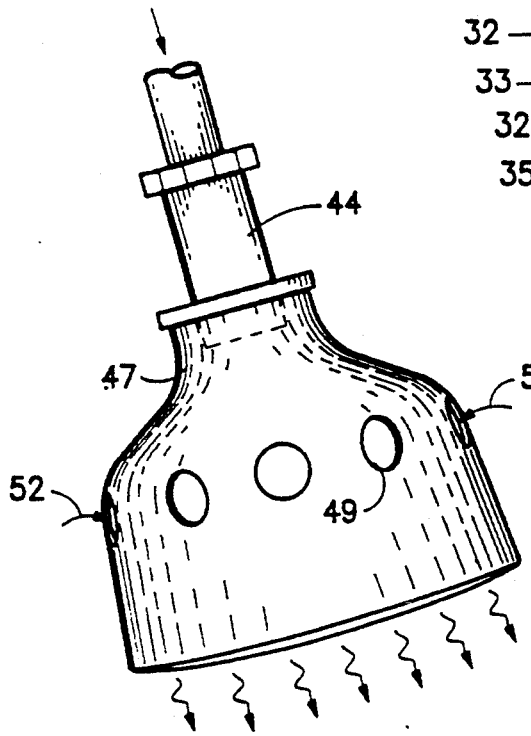
FIG. 2B is a further enlarged view of a modified burner which may be used instead of the burner shown in FIG. 2.

As shown in FIG. 2, a gas pipe 42 is connected to a gas burner nozzle 44, delivering an air/gas combustible mixture in a manner well known in the burner art. The burner nozzle 44 is mounted in a nozzle holder 46 which fixes the position of the burner nozzle and directs the gas flame from the burner nozzle into a mixing nozzle assembly 48. The nozzle holder 46 is attached to the mixing nozzle 48 by spaced straps or struts 50, so that the mixing nozzle is spaced from the nozzle holder 46. An alternate arrangement is shown in FIG. 2B, wherein the burner nozzle 44 is mounted in an outwardly flared nozzle holder 47 which also functions as a mixing nozzle. A series of relatively large openings 49, such as one inch diameter holes, is provided throughout the circumference of the nozzle holder 47. Either arrangement allows ambient air to be inspirated into the mixing nozzle, as indicated by the flow arrows 52, due to the suction developed at the mixing nozzle inlet. The mixing of ambient air with the gas flame results in the discharge of hot air into the disc which is significantly cooler than the original gas flame. The reduced temperature of the air stream provides sufficient heat to maintain the polymer in a molten state without thermal degradation or ignition of the polymer. The temperature within the disc is controlled by regulating the volume and the air/gas ratio of the air/gas mixture delivered to the burner nozzle 44. If desired, in order to further guard against oxidation of the polymer inside the disc, an inert gas may be mixed with, or may wholly replace, the inspirated air entering the mixing nozzles 48 or 47.

Figure 3:
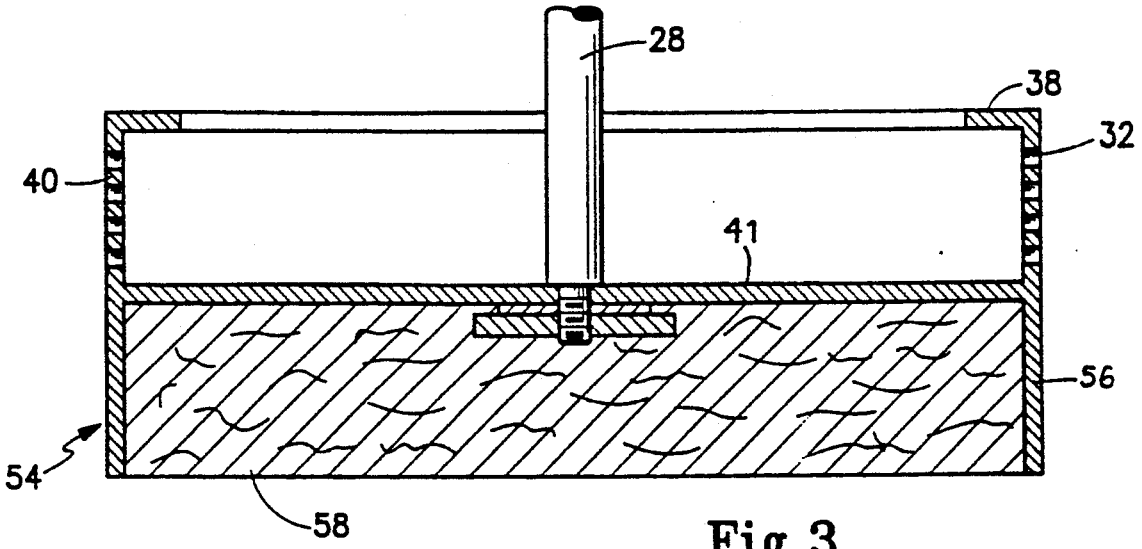
FIG. 3 is a longitudinal sectional view of a modified form of fiberizing disc.

Referring now to FIG. 3, wherein like reference numerals to those used in connection with previous drawing figures refer to similar elements, a modified fiberizing disc 54 is comprised of a bottom wall 41 and top flange 38 similar to the bottom wall and top flange of the disc shown in FIG. 2. This disc, however, includes a bottom flange 56 which extends downwardly from the sidewall 40 beneath the bottom wall 41. High temperature insulation 58, such as refractory fiber sold by Manville Corporation under the name "Cerachrome", is attached to the bottom flange 56 in order to insulate the bottom wall 41 to prevent heat loss through the bottom wall. Such an arrangement is not necessary in all cases and would be used only if heat loss from the disc is excessive or if difficulty is encountered in controlling the temperature of the molten polymer in the disc or the temperature profile of the bottom of the disc and the disc sidewall.

Figure 4:
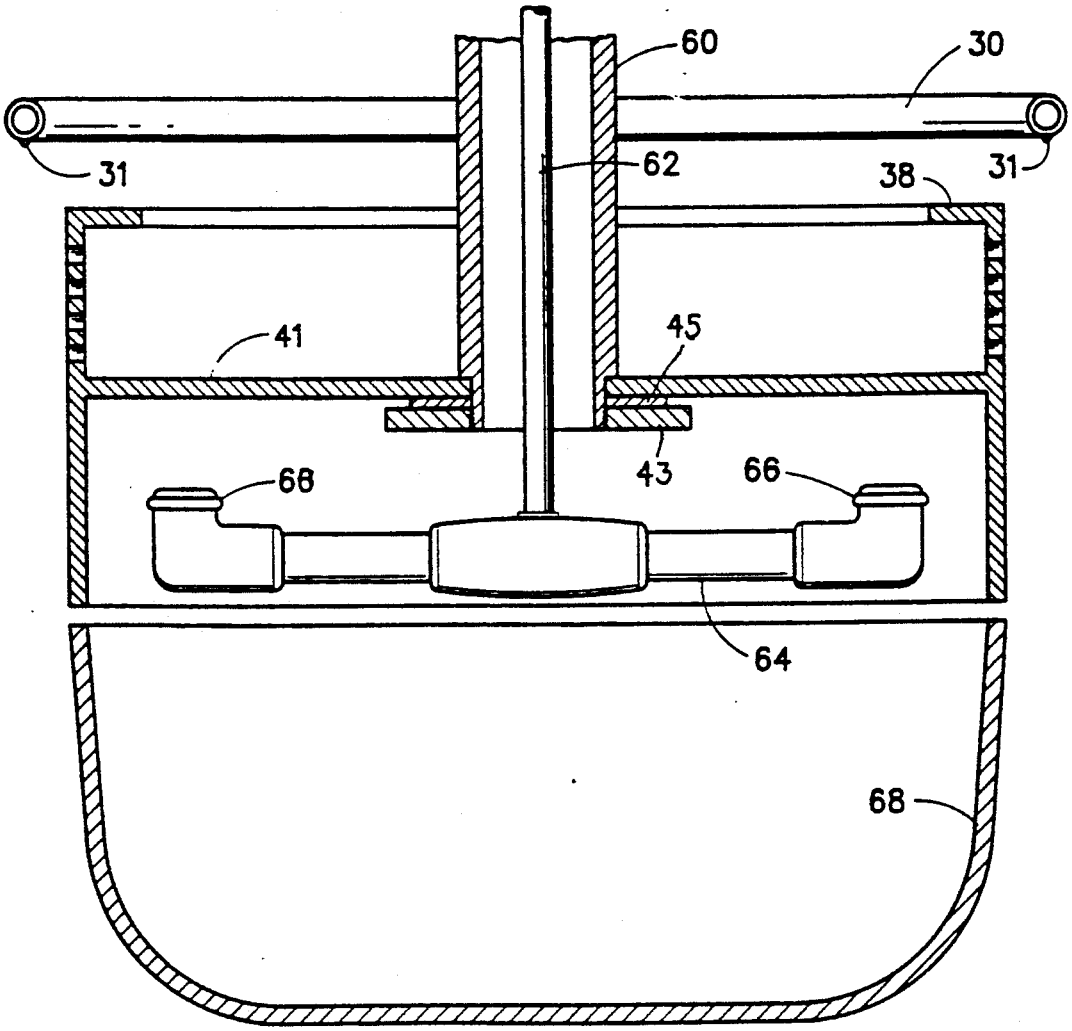
FIG. 4 is a longitudinal sectional view of another modified form of fiberizing disc.

If it is found that a top-heating gas burner does not provide sufficiently uniform heating of the disc, even with the use of insulation, it may be decided to heat the bottom of the disc as well. Since this would help achieve a more uniform disc temperature profile, improvement of product quality can be expected. One arrangement for heating the bottom wall of a fiberizing disc is shown in FIG. 4, wherein the rotary shaft 60 is hollow and is connected to the bottom wall 41 by a nut 43 in the manner described in connection with the shaft 28 of FIG. 2. A stationary gas and air delivery pipe 62 extends through the hollow shaft 60 down below the bottom wall 41 to a bottom burner manifold 64. Gas flow is divided by the manifold to one or more gas burner nozzles 66, and the resulting flames impinge on the bottom wall, heating the bottom of the disc. The amount of heat provided can be controlled by regulating the volume and ratio of the air/gas mixture delivered to the burner nozzles 66. In order to prevent fiber accumulation on the burners and manifold a protective shroud 68, which may be mounted by any suitable means, not shown, is provided to enclose the manifold. The size of the shroud is such that it lies inside the stream of fiber directed downward by the blast of air from the air ring 30, and thus does not interfere with the fiber stream. Induction and electric heating can also be used to maintain the proper disc temperature.

Figure 5:
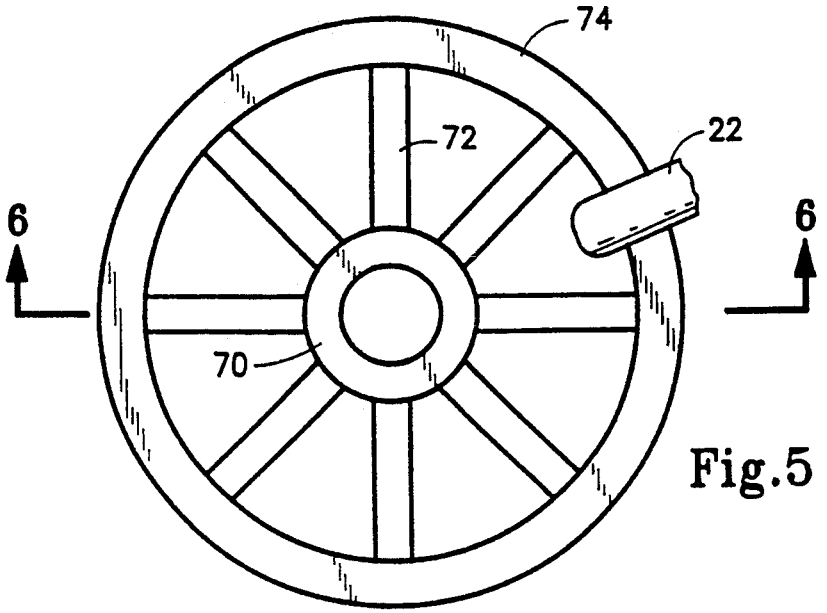
FIG. 5 is a plan view of a further embodiment of a fiberizing disc.
Figure 6:
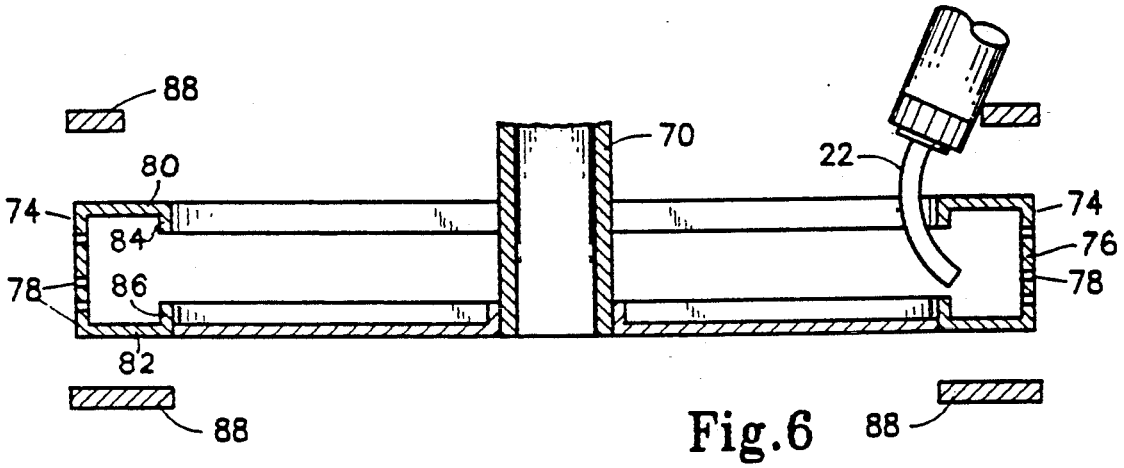
FIG. 6 s a longitudinal sectional view taken on line 6—6 of FIG. 5.

Another modified form of fiberizing disc is shown in FIGS. 5 and 6. In this embodiment a rotary shaft 70, which may be hollow to eliminate unnecessary mass, is connected by spokes 72 to an annular disc 74. The disc 74 is comprised of a sidewall 76 containing holes 78, and upper and lower walls 80 and 82, each of which preferably connect with spaced vertically arranged flanges 84 and 86, respectively. As shown in FIG. 6, induction heater 88 is provided to heat the outside of the disc. Since the annular disc requires the application of less heat than for a conventionally shaped disc of the same diameter, only the outside of the disc need be heated. Further, this design permits the polymer to be introduced into the disc by the transfer hose nozzle 22 near the sidewall of the disc, thus requiring only a minimum amount of time for the material to be processed into a fiber. Although the increased diameter allows for more force to be applied to the molten polymer as it is processed into fiber, the disc is lighter in weight than a conventional disc of similar diameter. This embodiment is designed to be used where a large size disc is needed in order to provide increased capacity on a single fiber production unit.

The air ring 30 shown in the drawing described thus far includes nozzles 31 which, as best illustrated in FIG. 2, are connected to the air ring in a fixed direction so as to provide a downwardly directed air blast spaced radially outwardly from the fiberizing disc. Although not illustrated, the air ring could be provided with specially contoured fixed holes instead of the nozzles. In either case, the fiber distribution resulting from this conventional arrangement is thus fixed, as is the size of the resulting mat built up on the moving conveyor beneath the fiberizing disc. In order to have more control over fiber distribution and mat size, the air ring of FIG. 7 can be used instead. This air ring is comprised of individual segments 90, each of which contains a nozzle 92. Each segment is hollow or contains a conduit through which air can flow, and each is rotatably or otherwise adjustably mounted on short connecting rods or shafts 94. An air line 96 may be connected to each segment 90 so as to deliver air under predetermined pressure to each of the segments, and each segment may be rotated relative to the adjacent short shafts 94. In this way each nozzle can be set to a desired angle to control the size of the mat and the fiber distribution in the mat. In addition, the air pressure to each of the nozzles can be regulated to aid in fiber attenuation and distribution.

Figure 7:
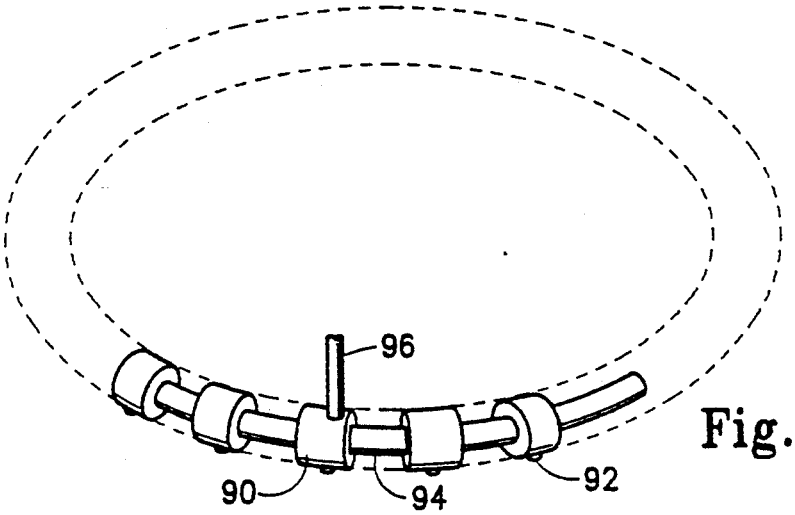
FIG. 7 is a pictorial view of a modified air ring for use in the process of the invention.
Figure 8:
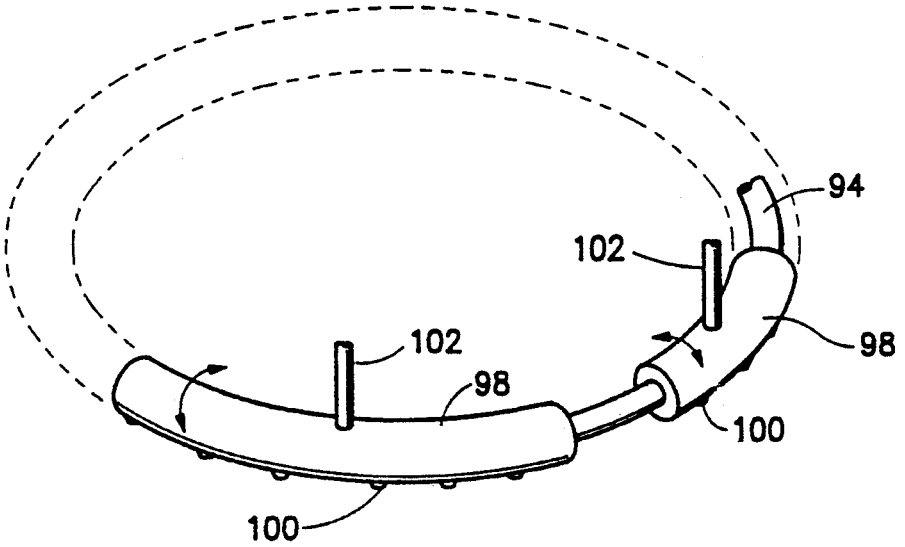
FIG. 8 is a pictorial view of another modified form of air ring.

As shown in FIG. 8, a modified version of the segmented air ring of FIG. 7 comprises longer segments 98, each of which includes a plurality of nozzles 100. Air lines 102 are connected to each segment 98 to supply compressed air to the nozzles 100. Each segment 98 is rotatably mounted on short shafts or rods 94, as in the embodiment of FIG. 7. The same benefits are derived from this design as discussed in connection with the air ring of FIG. 7, except that the design does not allow as much control of individual air nozzles. In many cases, however, the benefits derived from this arrangement are entirely adequate and the more complex air ring of FIG. 7 is not necessary. The use of segmented air rings would also have utility in the manufacture of inorganic fibers by means of a centrifugal spinning process.

In order to produce a fibrous blanket of specific width, thickness and density, it may be necessary to modify the fiber column discharging from the fiberizing disc so that it provides evenly distributed coverage of fiber on the moving collection belt below the disc. During normal operation of the process the fiber column forms a tight distinct column of entangled fibers in the vortex below the fiberizing disc. The vortex is formed as a result of the spinning motion of the disc, the area of low pressure formed below the disc and the vertical stream of air from the air ring. In accordance with the arrangement of FIG. 9, in order to change the direction of the falling fibers the bottom wall 41 of the disc is provided with an opening through which a hollow rotating shaft 104 extends. The tubular shaft 104 is attached to the bottom wall 41 at the opening, as by nut 105, so that the disc 24 rotates with the shaft. Extending axially through the tubular shaft 104 is a smaller diameter stationary hollow shaft 106 which carries a spray nozzle 108 on the lower end. The spray nozzle 108 is a nozzle which is capable of spraying a 360° fan of compressed air at 0° to 90° to the shaft 106 and is readily commercially available. Thus it provides a flow of compressed air generally perpendicular or less to the fiber flow. This action moves the fibers in an outward direction, thereby modifying the shape of the fiber column and eliminating the low pressure area which normally helps to hold the fiber column together.

Figure 9:
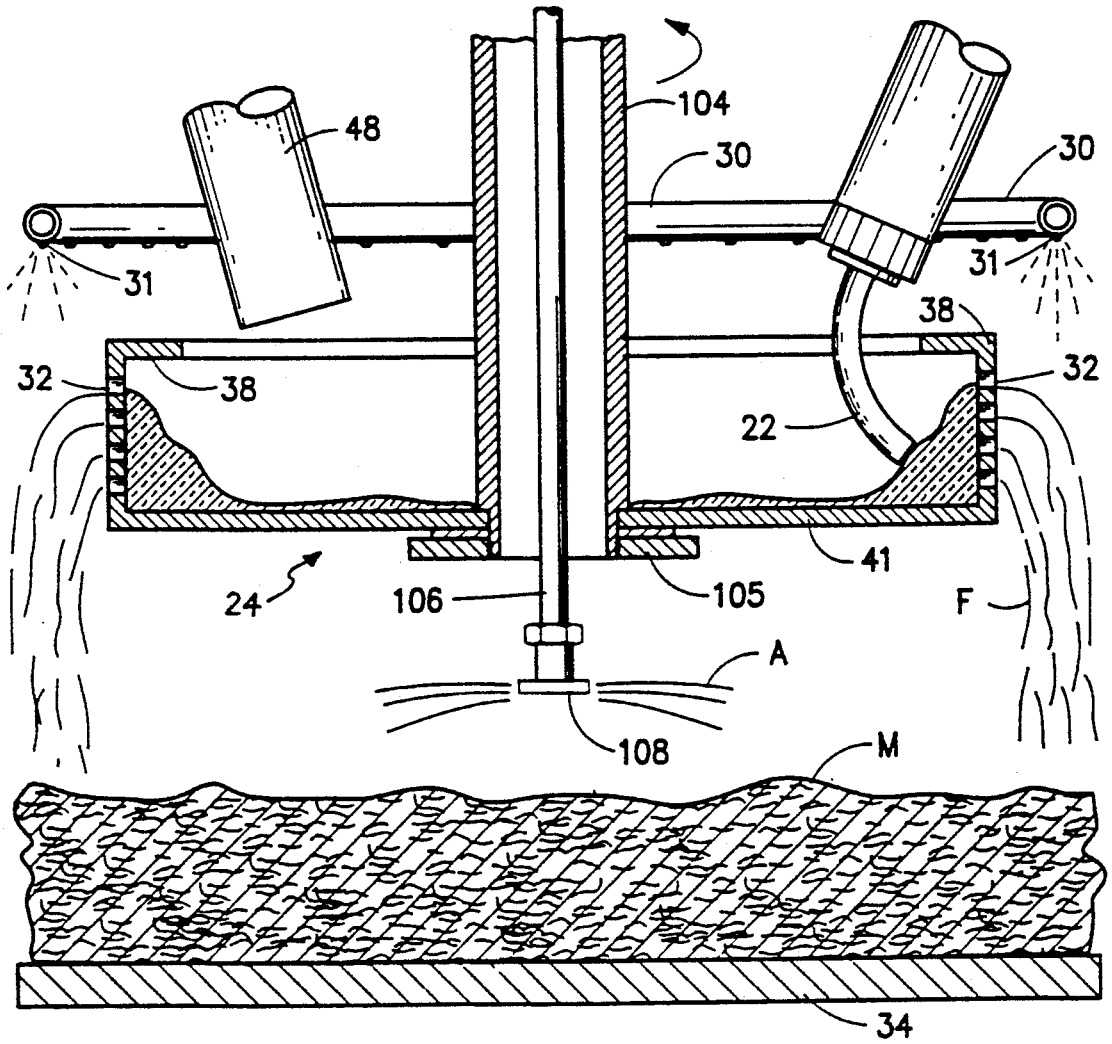
FIG. 9 is a longitudinal sectional view of the fiberizing disc and conveyor taken through a plane at right angles to the conveyor, showing means for distributing fibers uniformly across the width of the moving conveyor.

This is illustrated in FIG. 9 wherein the fibers F forming the column normally produced by the fiberizing disc 24 are outwardly diverted by the horizontal stream of compressed air A issuing from the spray nozzle 108. The new direction taken by the fibers allows the fibers to collect more evenly in the cross-machine direction on the moving collection chain or belt 34 and more accurately establishes the width of the resulting mat M.

Figure 10:
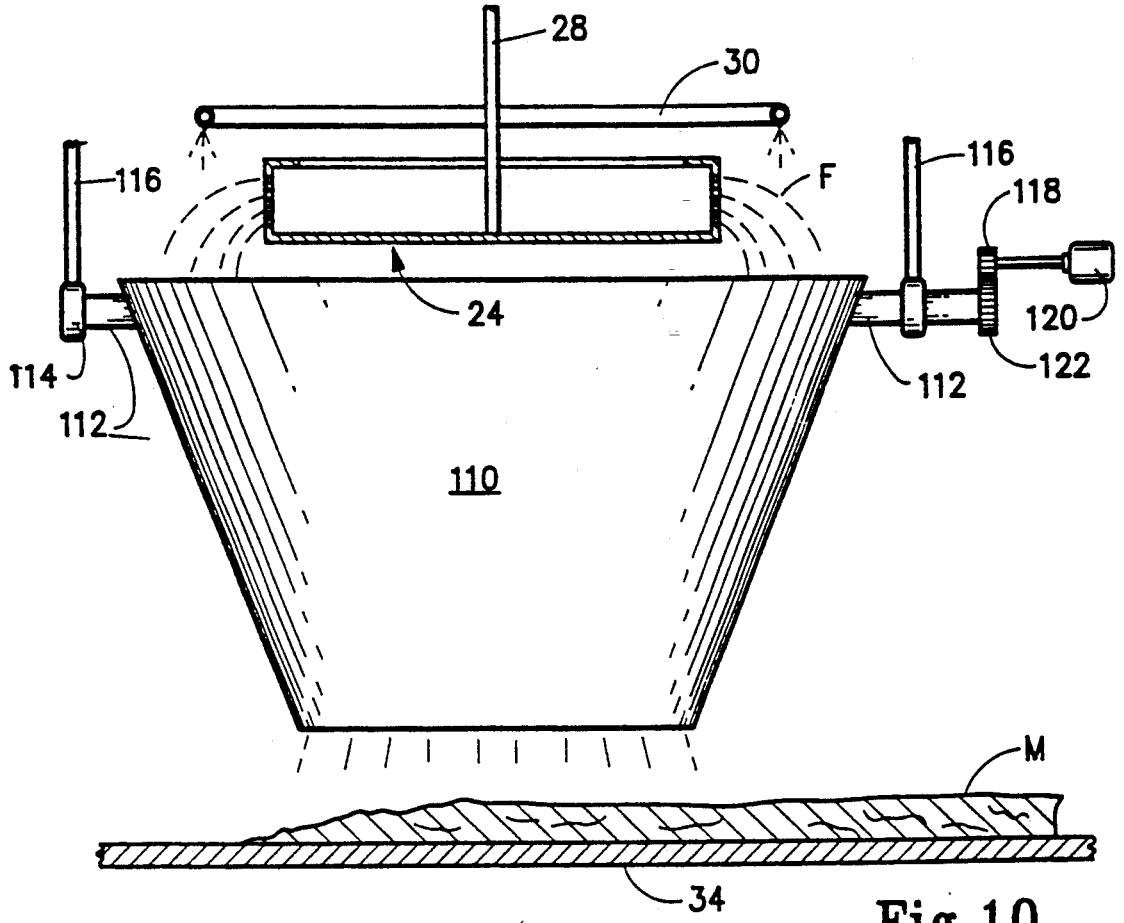
FIG. 10 is a side elevation of another means for distributing fibers uniformly across the width of the moving conveyor.
Figure 11:
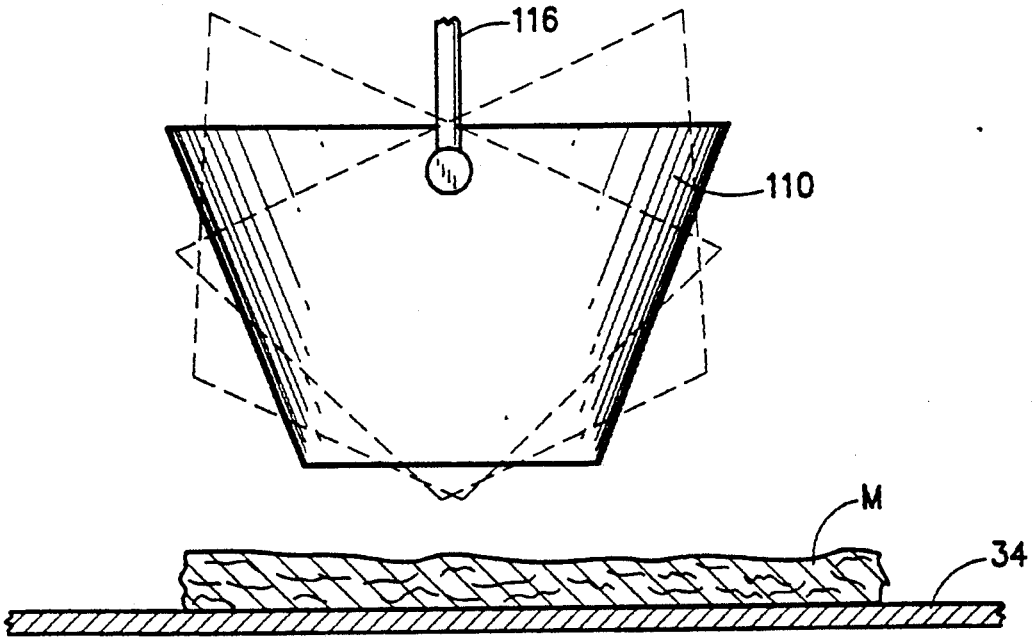
FIG. 11 is an end elevation of the fiber distributing means of FIG. 10.

Another method of better distributing fibers across the width of the moving collection belt is illustrated in FIGS. 10 and 11. In this arrangement an open-ended sheath or cone 110 is provided beneath the fiberizing disc 24 so that the fiber column or stream F generated by the fiberizing disc 24 is directed down into the cone. Shafts 112 extend from the upstream and downstream sides parallel to the movement of the conveyor 34. The shafts are supported for rotation in bearings 114 carried by hangers 116 supported from above by support structure, not shown. Suitable means are provided for rotating the shafts 112 through a small arc, such as 45° or less in each direction. For purpose of illustration, a spur gear 118 driven by motor 120 engages spur gear 122 mounted on the shaft 112. Operation of the motor in alternate opposite directions causes the shafts 112 to rotate in opposite directions in their bearings, resulting in the cone having a pivoting motion through the designated arc. This is shown better in FIG. 11, where the lateral extent of the pivoting movement of the cone is indicated in broken lines. The lateral extent of the mat M is thereby controlled.

The operation of the apparatus is carried out in a continuous manner, with each component of the apparatus functioning as explained above. It will be appreciated, however, that at the beginning of a production run, it will be necessary to clear the transfer tube 14 of any polymer or thermoplastic resin which may have remained inside from the last use and which have hardened. Referring back to FIG. 1, by heating the tube to a temperature higher than the melting point of the material for a sufficient length of time, and then opening the valve 17 which controls flow of compressed air through the line 19, compressed air is delivered into the tube. The compressed air purges any molten material in the tube, which is indicated by a steady flow of air from the nozzle 22. Of course the shut-off valve 16 would be closed during the purging operation. At the end of a run, the shut-off valve 16 is closed again and the valve 17 opened, allowing air to be delivered to the transfer tube to purge molten material remaining in the hose from the production run.

When forming fibers from thermosetting material, it should be possible to simply supply the material to the disc at the desired temperature directly from the source of heated resin. No extruder would be necessary.

It is known that organic fibers produced from polymer or thermoplastic and thermosetting resins are comprised of a blend of crystalline and amorphous structures, and that organic fibers made by a rotary process normally possess a greater amount of the crystalline phase than the amorphous phase. It has been found, however, that the fibers produced by the process of the invention are more amorphous than crystalline. It is believed that this is caused by the rapid cooling of the hot fibers experienced when they are contacted almost immediately after exiting the fiberizing disc by the stream of cooling and attenuating air from the air ring, thus precluding the extensive formation of crystals. The cooling is so rapid that molten fibers which exit the fiberizing disc at elevated temperatures in the ranges discussed and which are contacted a fraction of a second later by ambient air from the air ring can be grasped by an operator as they are falling at a point only one or two feet from the disc without injury or discomfort. X-ray diffraction of polypropylene fibers formed by the method of the invention has shown that the amorphous structure of the fibers is substantially greater than the crystalline structure, with the amount of the amorphous phase typically being at least 60% to 70% of the total fiber structure. This is of practical significance in view of the fact that the amorphous phase has a higher solubility than the crystalline phase, thus making the fibers of the invention more biodegradable.

It will now be appreciated that the apparatus described is designed to enable a rotary fiberizing process of the type used in the manufacture of glass fibers to be employed in the production of organic polymer and resin materials. The equipment can readily be commercially obtained or fabricated in accordance with known design criteria for the manufacture of fibers by the rotary or centrifugal spinning process.

It should also be apparent that the invention is not necessarily limited to all the specific details described in connection with the preferred embodiments, but that changes to certain features of the preferred embodiments which do not alter the overall basic function and concept of the invention may be made without departing from the spirit and scope of the invention, as defined in the claims.

What is claimed is:

1. Apparatus for producing organic fibers by means of a centrifugal spinning process, comprising:

a fiberizing disc having a diameter in the range of 3 inches to 48 inches connected to a substantially vertical shaft mounted for axial rotation;

the disc including a bottom wall, a circular sidewall extending upwardly from the bottom wall, terminating in an upper end, and having a vertical length extending from the bottom wall to the upper end, and an upper flange extending inwardly from the upper end of the circular sidewall;

means for introducing molten organic material capable of being fiberized by the rotating disc, said means including a nozzle located between the bottom wall, the circular sidewall and a plane extending through the upper end of the circular sidewall parallel to the bottom wall, the nozzle being positioned a short vertical distance from the bottom wall relative to the vertical length of the sidewall, the vertical distance being in the range of about ½ inch to 1½ inches, and a short horizontal distance from the circular sidewall relative to the diameter of the disc, the horizontal distance being in the range of about ½ inch to 3 inches; and means for uniformly heating the interior of the disc to maintain the material therein in a molten state;

the circular sidewall containing fiberizing holes through which the molten material exits during rotation of the disc; and a generally circular air ring located above and radially outwardly of the circular sidewall for directing compressed air in a downward direction.

2. The apparatus of claim 1, wherein the upper flange ranges in width from about ½ inch for a disc having a diameter of 3 inches to about 6 inches for a disc having a diameter of 48 inches.

3. The apparatus of claim 1, including additional heating means located beneath the bottom wall and being spaced therefrom for heating the bottom wall of the disc, the means for uniformly heating the interior of the disc being located above the disc.

4. The apparatus of claim 3, including a shroud extending downwardly from the bottom wall and enclosing the additional heating means to prevent fiber accumulation on the additional heating means.

5. The apparatus of claim 4, wherein the additional heating means comprises a burner and wherein the shaft is hollow, the apparatus further including a fuel line extending through the hollow shaft and connected to the additional burner.

6. The apparatus of claim 1, wherein the nozzle includes a transverse end portion directed generally outwardly toward the sidewall at an angle to both the bottom wall and the sidewall, whereby molten material discharged from the nozzle has both downward and sideward components of direction.

7. The apparatus of claim 1, wherein the means for uniformly heating the interior of the disc comprises a gas fired burner above the disc and a mixing nozzle between the burner and the disc, the heating means further including means for introducing a cooling gas into the mixing nozzle to reduce the temperature of the heat from the gas burner.

8. The apparatus of claim 7, wherein the means for introducing cooling gas comprises means for permitting the flow of ambient air to the mixing nozzle.

9. Apparatus for producing fibers by means of a centrifugal spinning process, comprising:

a fiberizing disc connected to a shaft mounted for axial rotation;

the disc including a bottom wall and a circular sidewall extending upwardly from the bottom wall;

means for introducing molten material capable of being fiberized by the rotating disc;

the sidewall of the disc containing fiberizing holes through which the molten material exits during rotation of the disc to produce fibers; and a generally circular air ring for directing compressed air in a downward direction at locations spaces radially outwardly of the disc;

the air ring being comprised of a plurality of arcuate segments, each segment forming a portion of the generally circular air ring and being connected to a source of compressed air, each segment containing at least one downwardly directed nozzle and being adjustably mounted so as to enable the direction of the nozzles to be varied.

10. The apparatus of claim 9, wherein said at least one downwardly directed nozzle includes a plurality of nozzles.

11. Apparatus for producing organic fibers by means of a centrifugal spinning process, comprising:

a fiberizing disc connected to a substantially vertical shaft mounted for axial rotation;

the disc including a bottom wall, and a circular sidewall extending upwardly from the bottom wall and terminating in an upper end, and an upper flange extending inwardly from the upper end of the sidewall;

means for introducing molten organic material capable of being fiberized by the rotating disc, said means including a nozzle located between the bottom wall, the sidewall and a plane extending through the upper end of the sidewall parallel to the bottom wall;

means for uniformly heating the interior of the disc to maintain the material therein in a molten state;

the sidewall containing fiberizing holes through which the molten material exits during rotation of the disc;

a generally circular air ring comprised of a plurality of arcuate segments located above and radially outwardly of the circular sidewall, each segment forming a portion of the generally circular air ring and being connected to a source of compressed air, each segment containing at least one downwardly directed nozzle and being adjustably mounted so as to enable the direction of the nozzles to be varied.

12. The apparatus of claim 11, wherein said at least one downwardly directed nozzle includes a plurality of nozzles.

* * * * *